United States Patent [19]

Burt

[11] 4,246,702

[45] Jan. 27, 1981

[54] APPARATUS FOR USE IN DRAWING DESIGNS

[76] Inventor: Frank R. Burt, Box 296A, Jay, Me. 04239

[21] Appl. No.: 98,542

[22] Filed: Nov. 29, 1979

[51] Int. Cl.[3] ..... B43L 13/20

[52] U.S. Cl. ..... 33/174 B; 33/27 L

[58] Field of Search ..... 33/174 B, 27 L, 430

[56] References Cited

U.S. PATENT DOCUMENTS

| | | | |
|---|---|---|---|
| 1,022,384 | 4/1912 | Bahr | 33/174 B |
| 1,211,793 | 1/1917 | Horvath | 33/174 B X |
| 2,409,019 | 10/1946 | Cree | 33/174 B X |
| 2,570,806 | 10/1951 | Henry | 33/174 B X |
| 3,535,791 | 10/1970 | Oppenheim | 33/27 L |
| 3,665,610 | 5/1972 | Schlau et al. | 33/18 R |
| 3,696,530 | 10/1972 | Bryant | 35/28 |

*Primary Examiner*—Harry N. Haroian

[57] ABSTRACT

Apparatus for use in drawing designs has a tray dimensioned to receive a sheet of drawing paper of predetermined dimensions with the side walls of the tray having lengthwise slots. One end of a wand is insertable through a selected slot with the other end serving as a handle and the wand is held in the slot for sliding and pivotal movement relative thereto. At least one stencil plate is detachably attached to the end of the wand within the tray and the wand is of such length that the stencil may be moved over a substantial portion of the sheet.

13 Claims, 7 Drawing Figures

APPARATUS FOR USE IN DRAWING DESIGNS

BACKGROUND REFERENCES

U.S. Pat. No. 2,570,806
U.S. Pat. No. 3,535,791
U.S. Pat. No. 3,665,610

BACKGROUND OF THE INVENTION

Interest in the drawing of designs is not limited to any age group so that apparatus for that purpose must be sufficiently versatile to enable simple designs to be made by children and intricate designs to be created by teenagers and adults as well, both for their own entertainment or, for example, as designs for posters, place mats, wall paper, and embroidery.

The use of stencil plates makes possible the drawing of complex designs, but, as far as I am aware, their utility has been limited by the fact that they have been held in use in a fixed position relative to the holder of the drawing paper.

THE PRESENT INVENTION

The general objective of the invention is to provide drawing apparatus that while of simple construction and easy to use by children is sufficiently versatile to create interest in drawing designs by teenagers and adults, both for their own entertainment and for the creation of designs for commercial purposes.

In accordance with the invention, this objective is attained with a tray dimensioned to hold such a paper sheet and having at least two adjacent marginal walls provided with lengthwise slots through a selected one of which one end of a wand may be inserted over the paper sheet and then have a stencil plate attached thereto. The wand, once entered through a slot is slidably held by and pivotally connected to the tray in any one of a series of positions along the wand so that the attached stencil plate may be moved over a substantial portion of the paper both linearly and arcuately as a design is being created using a pen or pencil that is preferably colored for that purpose.

Another objective of the invention is to make provision for the holding of the paper sheet in the tray, an objective attained with the tray having a slideway that is open through one end wall and dimensioned to enable the sheet to be positioned on the bottom of the tray with its margins under the inner edges of the marginal walls. A particular objective is to have the walls of the tray in the form of a frame attached to a base by adjustable resiliently yieldable connections that enable the relationship of the frame to the base to be quickly and easily varied in order that paper sheets of various thickness may be easily placed in the slideway and easily removed and also to enable the wand to be inserted without catching on the paper sheet.

Other objectives of the invention are concerned with the connection of the stencil plates to the wand and to the stencil plates themselves. To that end, at least one end of the wand has a planar head and each stencil plate has a recess in a side that is shaped and dimensioned to enable it to be fitted on and held by the wand head.

A stencil plate construction that has marginal indentations on each surface that provides corresponding projections on the opposite surface is a preferred feature of the invention as it enables a different stencil plate to be positioned on and held by the stencil plate that is held by the wand head and the projections serve to hold the plates out of contact with the paper.

Other objectives of the invention will be apparent from the following description of the preferred embodiment and the appended claims.

BRIEF DESCRIPTION OF THE DRAWINGS

The accompanying drawings illustrate a preferred embodiment of the invention of which

THE PREFERRED EMBODIMENT OF THE INVENTION

Figure 1:
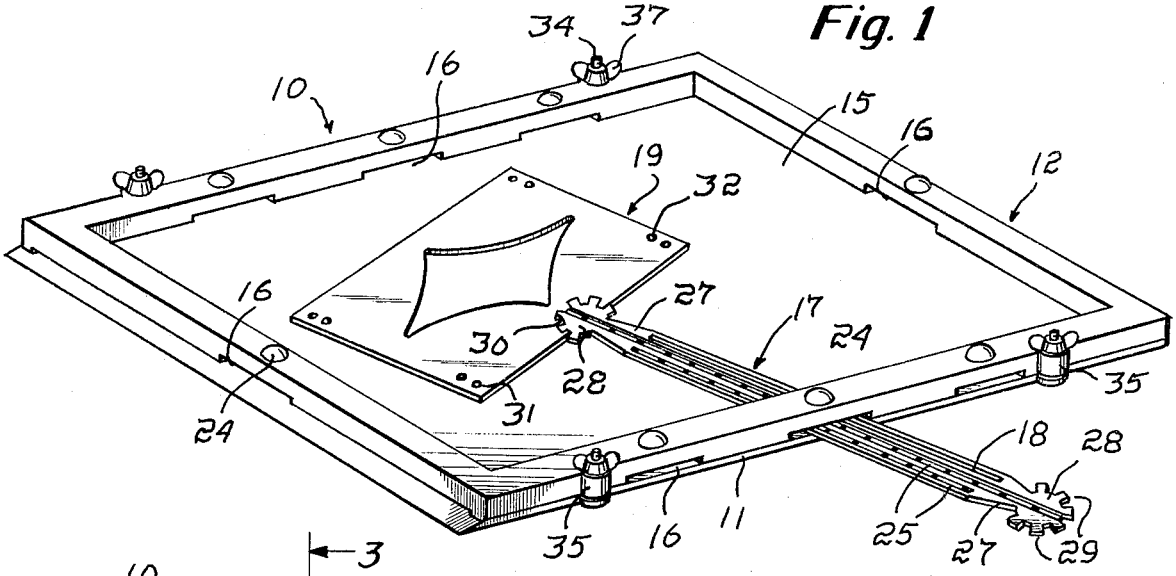
FIG. 1 is a perspective view of the apparatus.
Figure 2:
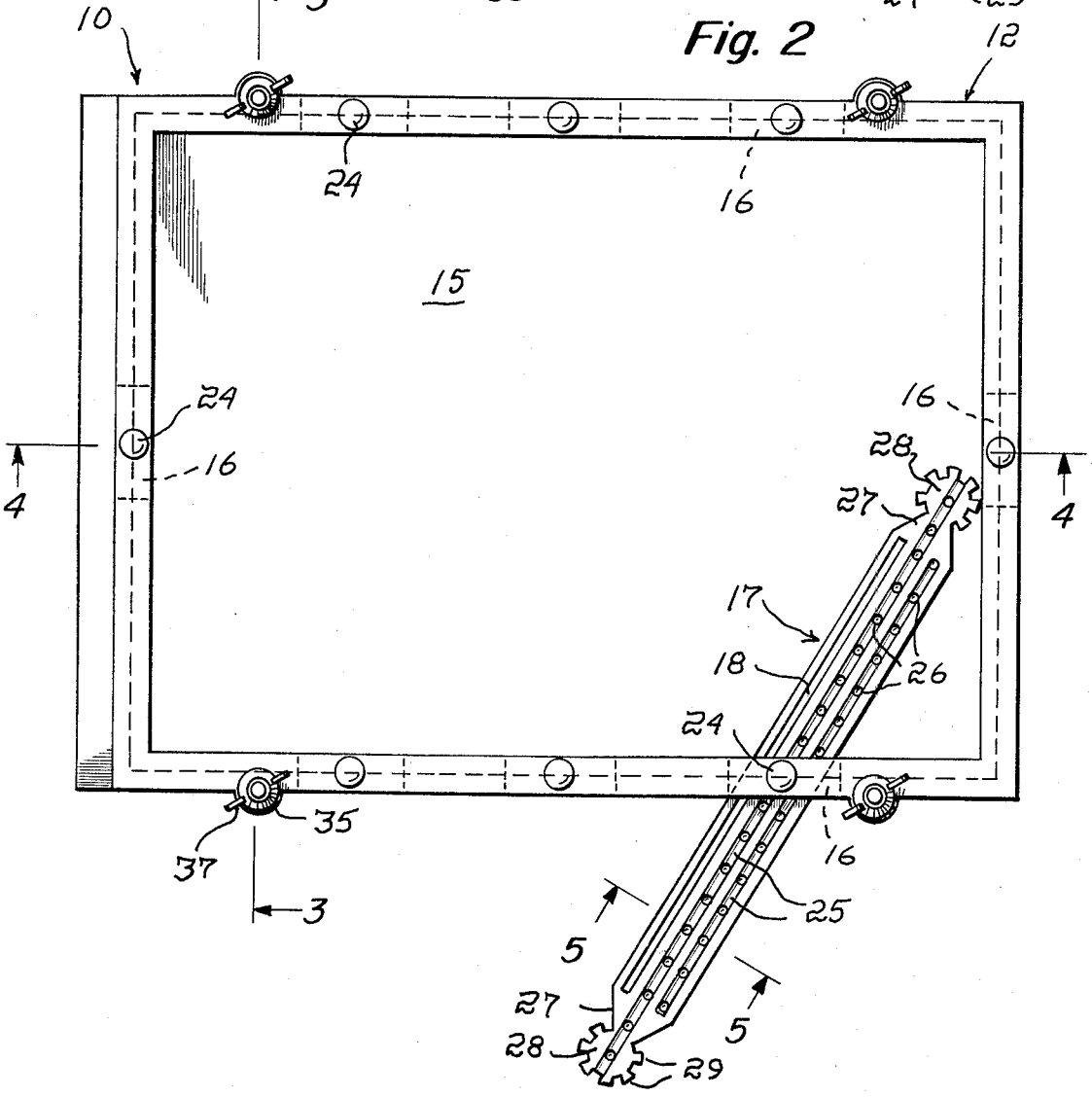
FIG. 2 is a plan view thereof on an increase in scale and with the stencil plate removed.

In accordance with the invention, a rectangular tray, generally indicated at 10, is provided that has a flat base 11 and a frame 12 which is shown as of molded plastic and attached thereto and establishing the side walls thereof. The sides and one end wall of the frame have a shallow rabbet 13 along the inner edges of their bottom surfaces and the bottom surface of the other frame end wall has a shallow lengthwise recess providing the tray with a slot 14 through which a paper sheet 15 may be entered and slid into position with its margins under the frame in the space provided by the rabbets 13.

The sides and ends of the frame 12 are also formed with transverse channels establishing lengthwise slots 16 in the sides of the tray. The slots 16 are dimensioned to enable an end of a wand 17 to be slid therethrough and of a length somewhat greater than the width of the wand.

The wand 17 is of a clear plastic and has a lengthwise slot 18 adjacent one edge and dimensioned to enable the point of a pen or pencil to be inserted therethrough and mark the sheet 15 and is so formed at its ends as to enable a stencil plate 19 or 20 to be detachably attached to whichever end of the wand has been entered into the tray through a side wall slot 16.

The wand 17 and the tray wall above each slot 16 are provided with complemental means enabling the wand 17 to be slid relative to the side wall of the tray through which it has been entered and pivotally connected thereto in any one of a series of positions lengthwise of the wand.

Figure 4:
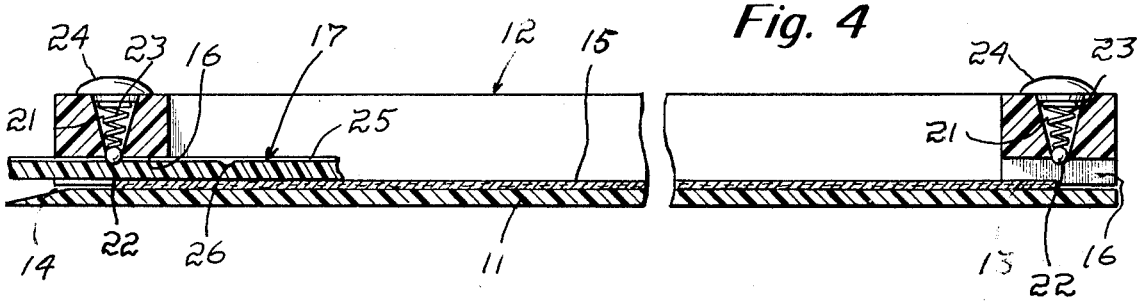
FIG. 4 is a section, on the scale of FIG. 3, taken approximately along the line 4—4 of FIG. 2.
Figure 5:
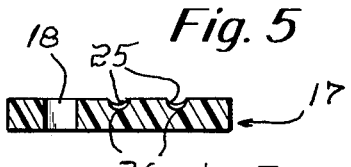
FIG. 5 is a section taken along the line 5—5 of FIG. 2.
Figure 6:
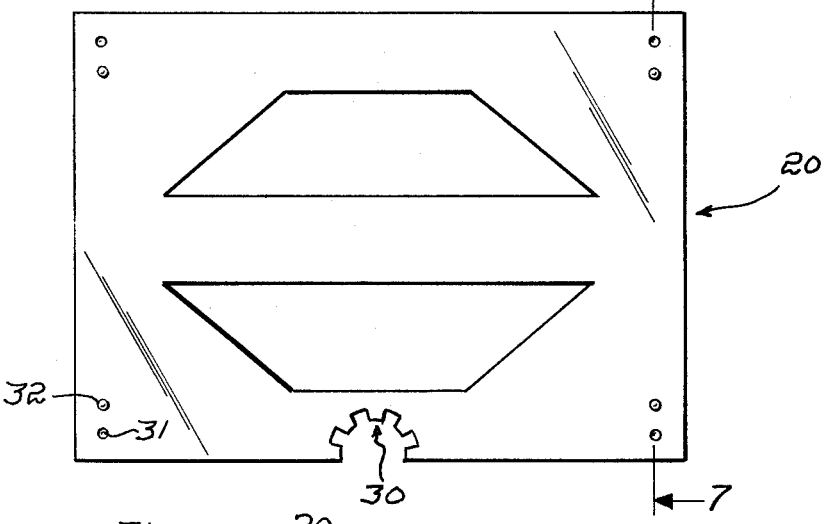
FIG. 6 is a plan view of a stencil plate.

To that end, the frame has, see FIG. 4, a conical recess 21 opening downwardly into each slot 16 with a detent ball 22 partially exposed therein and backed by a spring 23 held captive by a cap 24 sealed to the frame. The wand 17 has a pair of shallow grooves 25 one centrally of the wand and the other adjacent the side of the wand opposite the slot 18. Each groove 25 has a lengthwise series of uniformly spaced indentations 26 each adapted to coact with the detent ball 22 in providing a pivotal connection between the wand and the tray side wall that is easily released as the user pulls or pushes the wand to change the position of the attached stencil plate.

Figure 7:
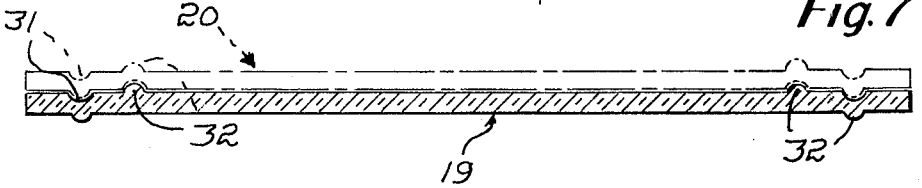
FIG. 7 is a section, on a substantial increase in scale, taken along the indicated line 7—7 of FIG. 6, with another stencil plate, shown in phantom as combined therewith.

For the attachment of a stencil plate 19 to the wand, each of its ends is formed with a neck 27 and a head 28 provided with an arcuate series of teeth 29 spaced and dimensioned to fit a complemental recess 30 in a margin of each stencil plate. In practice, a set of several different stencil plates is provided. Each plate is of clear plastic and has indentations in the corners of both faces each of which establishes a corresponding projection 32 on the opposite face so that an attached plate will be held out of contact with the paper sheet 15 except at its corners as the plate is moved from one position to another following the pen or pencil. In addition, this plate construction enables one plate to be seated on another and held against movement relative thereto enabling two designs to be combined to create a third design, see FIG. 7.

Figure 3:
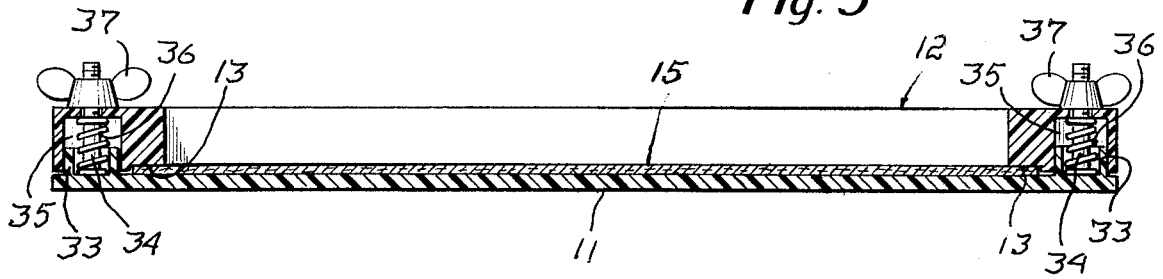
FIG. 3 is a section, on a further increase in scale, taken approximately along the indicated line 3—3 of FIG. 2.

In order that the paper sheet can be securely held while a design is being drawn and later easily removed, the base is molded, see FIG. 3, to provide two sleeve portions 33 spaced along each side with a threaded stud 34 within each sleeve 33. Each side of the frame 12 has downwardly opening sockets 35 one for each sleeve portion 31 and dimensioned to receive that sleeve portion within it and a spring 36 bottomed therein. The sockets 35 have holes permitting the studs 34 to pass upwardly through the frame sides and wing nuts 37 threaded on the studs enable the frame to be clamped to the base 11 or loosened to permit the springs to so raise the frame as to enable the wand 17 to be inserted or removed without catching on the paper and the paper to be easily removed. Such connections between the frame and the base also permit paper sheets of different thickness to be used.

By way of example, and not of limitation, the tray 10 may be made to accommodate 9"×12" paper sheets with the slots one and one-half inch in length with the wands twelve inches long, one inch wide and a sliding fit in each slot 16.

With one or more design plates 19 fixed on the wand 17 and the wand advanced to position the plate in a wanted position, the design is commenced using a pen or pencil, preferably colored, with the plate free to be moved along an arcuate path as the design is drawn and easily moved radially. A stencil plate 19 may be attached to the wand 17 in positions other than that shown in FIG. 1. The recess 20 is in a straight side of the stencil plate and the neck 27 has straight sides and so tapers inwardly towards the head that a stencil plate may be attached to the head 28 with its straight edge at either side of the recess 30 adjacent or against the corresponding side edge of the neck 27 and defining an acute angle with the center line of the wand 17.

I claim:

1. Apparatus for use in drawing designs, said apparatus including a tray having vertical marginal walls and dimensioned to receive and hold a sheet of paper of predetermined dimensions, said walls having lengthwise slots, a wand of transparent stock extendable through a selected one of said slots over a paper sheet positioned in the tray with an end outside the tray to serve as a handle, means detachably connecting said wand to the wall having the selected slot when an end of the wand is inserted therethrough and enabling the connected wand to be slid and pivoted relative thereto, a transparent stencil plate, and means detachably connecting said plate to the end of the wand within the tray, said wand of such length that the stencil plate may be moved over a substantial portion of the sheet.

2. The apparatus of claim 1 in which the wand connecting means includes a detent for each lengthwise slot, each detent including a spring backed member exposed midway of the ends of the associated slot and the wand has at least one lengthwise ball receiving channel and a series of indentations spaced along the channel, each serving as a releasable pivot point when the ball is releasably caught therein.

3. The apparatus of claim 1 in which the wand has a lengthwise slot dimensioned to slidably receive the point of a pen or pencil.

4. The apparatus of claim 2 in which the wand also has a lengthwise slot dimensioned to slidably receive the point of a pen or pencil.

5. The apparatus of claim 1 in which the means connecting the stencil plate to the wand includes coplanar complemental interfitting portions.

6. The apparatus of claim 5 in which the interfitting portion of the wand is a head at least at one end thereof, the head provided with a convex arcuate series of teeth and the stencil plate has a recess in one side provided with a complemental concave arcuate series of teeth.

7. The apparatus of claim 6 in which the wand has a neck tapering inwardly towards the head and connected thereto, and the side of the plate having the recess is spaced relative to the side edge of the neck that the plate may be attached to the head in a plurality of positions relative to the center line of the wand.

8. The apparatus of claim 5 in which the wand has a lengthwise slot adjacent one side edge dimensioned to slidably receive the point of a pen or pencil, a head portion at each end to fit the complemental portion of the stencil plate, and the means connecting the wand to the tray includes a detent for each lengthwise slot, each detent includes a spring backed member exposed in the slot midway between the ends thereof, and the wand has two channels, one adjacent the other edge thereof and one extending along the center line of the wand, and each channel includes a series of indentations spaced lengthwise thereof each of which series as a releasable pivot point when the spring backed member is caught therein.

9. The apparatus of claim 1 in which the tray has a slideway opening through one end wall of the tray to receive the paper sheet with its margins confined under the inner edge of said walls.

10. The apparatus of claim 9 in which the tray includes a flat base and the side walls are a frame, and the means connecting said frame to the base include springs yieldably urging said frame into a position spaced above the base and means operable to connect the frame to the base in opposition to the springs.

11. The apparatus of claim 1 in which each stencil plate has indentations in each face marginally of the design area thereof, the indentations providing corresponding projections on the opposite face of the plate which serve to hold the plate out of contact with the paper sheet also to enable one plate to be held in position on a subjacent plate.

12. A stencil plate to be attached to one end of a wand having a planar head at one end thereof having a convex arcuate series of teeth, said plate of a transparent plastic and having a recess in one side including a complemental concave arcuate series of teeth and operate to connect the plate to the wand head when the complemental teeth are fitted together.

13. The stencil plate of claim 12 and a series of indentations in each face spaced from the design area of the plate and providing corresponding projections on the opposite face of the plate.

* * * * *